US006848429B2

(12) United States Patent
Mori

(10) Patent No.: US 6,848,429 B2
(45) Date of Patent: Feb. 1, 2005

(54) FUEL INJECTION PUMP

(75) Inventor: Katsumi Mori, Chiryu (JP)

(73) Assignee: Denso Corporation, Aichi-Pref. (JP)

( * ) Notice: Subject to any disclaimer, the term of this patent is extended or adjusted under 35 U.S.C. 154(b) by 415 days.

(21) Appl. No.: 09/775,594

(22) Filed: Feb. 5, 2001

(65) Prior Publication Data

US 2001/0015200 A1 Aug. 23, 2001

(30) Foreign Application Priority Data

Feb. 18, 2000 (JP) ..... 2000-040959

(51) Int. Cl.[7] ..... F02M 37/04
(52) U.S. Cl. ..... 123/495; 417/470; 123/509
(58) Field of Search ..... 123/495, 509; 417/470, 529, 434

(56) References Cited

U.S. PATENT DOCUMENTS 5,884,608 A * 3/1999 Cooke ..... 123/495
5,967,123 A * 10/1999 Ruoff et al. ..... 123/495

FOREIGN PATENT DOCUMENTS

| | | |
|---|---|---|
| GB | 2177759 A | 1/1987 |
| JP | 53-71110 | 11/1976 |
| JP | 54-165607 | 5/1978 |
| JP | 61-9124 | 3/1986 |
| JP | 2-42173 | 2/1990 |
| JP | A-7-119495 | 5/1995 |

* cited by examiner

*Primary Examiner*—Carl S. Miller
(74) *Attorney, Agent, or Firm*—Nixon & Vanderhye PC

(57) ABSTRACT

In a fuel injection pump, a helical gear is attached to an end of a camshaft and rotatable with the camshaft. The camshaft is biased in one axial direction thereof by a driving force that the helical gear receives from an engine crankshaft. A disk is provided in a position of the camshaft extending forward from a cam to the direction in which the camshaft is biased. An axial movement of the disk is restricted via a washer by an end of a bearing cover. The disk is formed in the same axis to a portion of the camshaft that is held by a journal bearing. An outer diameter of the disk is larger than that of the cam. An area where the disk and the washer are in sliding contact with each other is relatively large and the sliding regions thereof are constant so that hammer noises are prevented and frictional wear thereof are limited.

5 Claims, 3 Drawing Sheets

FUEL INJECTION PUMP

CROSS REFERENCE TO RELATED APPLICATION

This application is based upon and claims the benefit of priority of Japanese Patent Application No. 2000-40959 filed on Feb. 18, 2000, the content of which is incorporated herein by reference.

BACKGROUND OF THE INVENTION

1. Field of the Invention

The present invention relates to a fuel injection pump for an internal combustion engine (hereinafter called engine), in particular, a construction of the pump with no hammer noises and less frictional wear.

2. Description of Related Art

In a conventional fuel injection pump, a driving force is transmitted to a camshaft via a belt or a gear from an engine crankshaft. A cam attached to the camshaft drives a movable member so that the movable member makes a reciprocating movement. Accordingly, the fuel injection pump pressurizes and delivers fuel sucked in a fuel pressure chamber.

When the camshaft is rotating, the camshaft often moves in an axial direction thereof so that the cam is likely to hit a surface of a housing and make hammer noises. To cope with the hammer noises, it is preferable that the fuel injection pump is provided with biasing means for urging the camshaft in one axial direction thereof to prevent the camshaft from moving to and fro in an axial direction.

In a small engine whose driving force is relatively small, a belt has been used to transmit the driving force to the camshaft. In a large engine whose driving force is relatively large, a gear has been generally used to transmit the driving force to the camshaft from the engine crankshaft. In the case where the gear is used for transmitting the driving force, a helical gear is preferable since the helical gear acts as the biasing means for urging the camshaft in the one axial direction thereof. Further, the helical gear serves to minimize a backrush in mesh so that, when the cam drives the movable member, the driving force transmitted to the cam is relatively even.

In this case, while the camshaft is urged in the one axial direction thereof, a stopper surface, which comes in contact with the cam, is provided in the housing for restricting an axial movement of the camshaft. Accordingly, the cam slides the stopper surface according to a rotation of the camshaft. Face pressure at the respective portions where the cam and the stopper surface are in slidable contact with each other differ depending on a radial distance from an axis of the camshaft and, in particular, face pressure at a lower cam rise portion becomes higher. Further, a region of the stopper surface in slidable contact with the cam varies according to the rotation of the camshaft due to hill and dale profile of the cam. Therefore, frictional wear of both of the cam and the stopper surface are likely to be accelerated so that endurances of the cam and the stopper surface become shorter.

Further, even if the camshaft is biased in the one axial direction and the cam is in slidable contact with the stopper surface, the camshaft is sometimes moved to the other axial direction due to reaction. To limit a backward movement of the camshaft, it is preferable that a clearance between the cam and the housing on an opposite side to the stopper surface is as small as possible. However, it is rather difficult to adjust adequately the clearance between the cam and the housing.

SUMMARY OF THE INVENTION

An object of the present invention is to provide a fuel injection pump having a construction that is unlikely to cause hammer noises and frictional wear.

It is another object to provide a fuel injection pump in which an adjustment for restricting an axial movement of the camshaft is easy.

To achieve the above objects, the fuel injection pump has a disk shaped member provided at any one of axially extending positions of a camshaft other than a cam in the same axis to a portion of the camshaft which is held by a bearing. The disk shaped member is biased in the one axial direction of the camshaft by biasing means against and in slidable contact with a stopper surface so that the axial movement of the camshaft is restricted. Accordingly, the cam does not contact the stopper.

It is preferable that an outer diameter of the disk shaped member is larger than that of the cam. With this construction, an area where the disk shaped member and the stopper are in slidable contact with each other becomes larger, compared with an area where the cam and the stopper surface are in slidable contact with each other. Accordingly, face pressure on portions of the disk shaped member and the stopper surface in contact with each other becomes lower. Further, as the disk shaped member is arranged in the same axis to the camshaft, contacting regions of the disk shaped member and the stopper are always the same. Accordingly, frictional wear of the disk shaped member and the stopper surface are limited and lifetimes thereof are prolonged.

It is preferable that a helical gear coaxially rotatable with the camshaft receives a driving force for driving the camshaft. The helical gear serves to limit a backrush generated when the cam drives a moving member so that the driving force applied to the moving member becomes even. Further, the helical gear acts as the biasing means for biasing the camshaft in the one axial direction thereof. As a result, it is not necessary to employ separately a biasing means such as a spring.

When an axial distance of a space where the disk shaped member is housed is too narrow, the disk shaped member is held by walls on opposite sides of the space and frictional wear is accelerated. On the other hand, when the axial distance of the space is too large, the camshaft often moves in an opposite direction to the axial biasing direction so that hammer noises are likely to occur. Therefore, prefererably, the disk shaped member is housed in advance in a space provided axially between first and second connecting members which are separate bodies from the housing. The axial distance of the space is easily adjusted before the camshaft is assembled to the housing, for example, by screwing the second connecting member into the first connecting member.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS (First Embodiment)

A fuel injection pump for a diesel engine according to a first embodiment of the present invention is described with reference to FIGS. 1 and 2.

Figure 1:
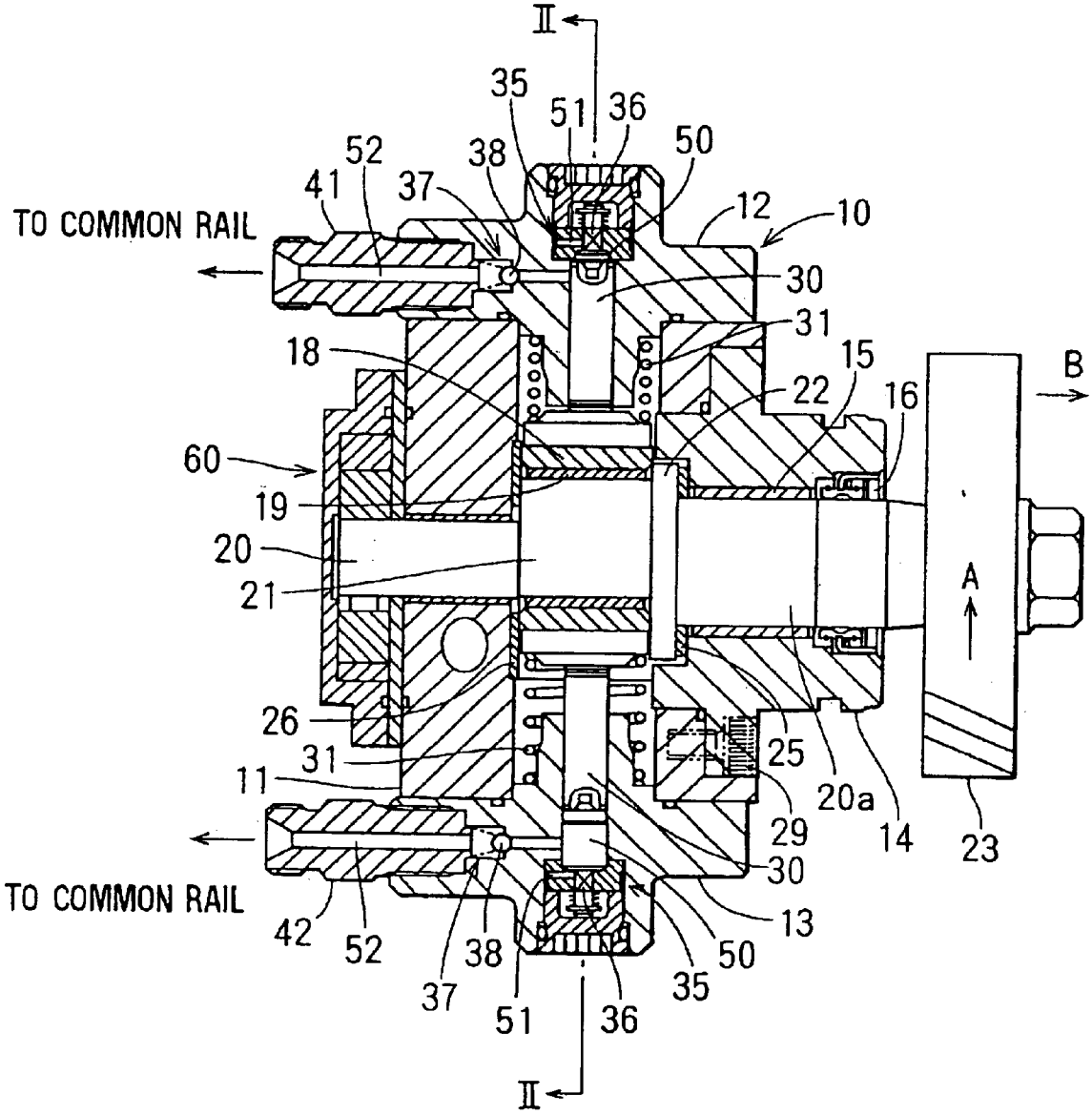
FIG. 1 is across sectional view showing a fuel injection pump according to a first embodiment of the present invention.

As shown in FIG. 1, a pump housing of the fuel injection pump 10 is composed of an aluminum housing body 11 and a pair of iron cylinder heads 12 and 13. Each of the cylinder heads 12 and 13 has a bore in which a plunger 30 as a moving member is slidably and reciprocatingly held. A fuel pressure chamber 50 is formed in each of the bores of the cylinder heads 12 and 13 between an end of the plunger 30 and an end of a return valve 35 having a return valve element 36.

A bearing cover 14 is fixed to the housing body by bolts 29. A journal bearing 15 for holding a camshaft 20 is rigidly fitted into a center bore of the bearing cover 14.

The camshaft 20 is rotatably held by the housing body 11 and by the bearing cover 14 via the journal bearing 15. An oil seal 16 seals a clearance between the central bore of the bearing cover 14 and the camshaft 20.

Figure 2:
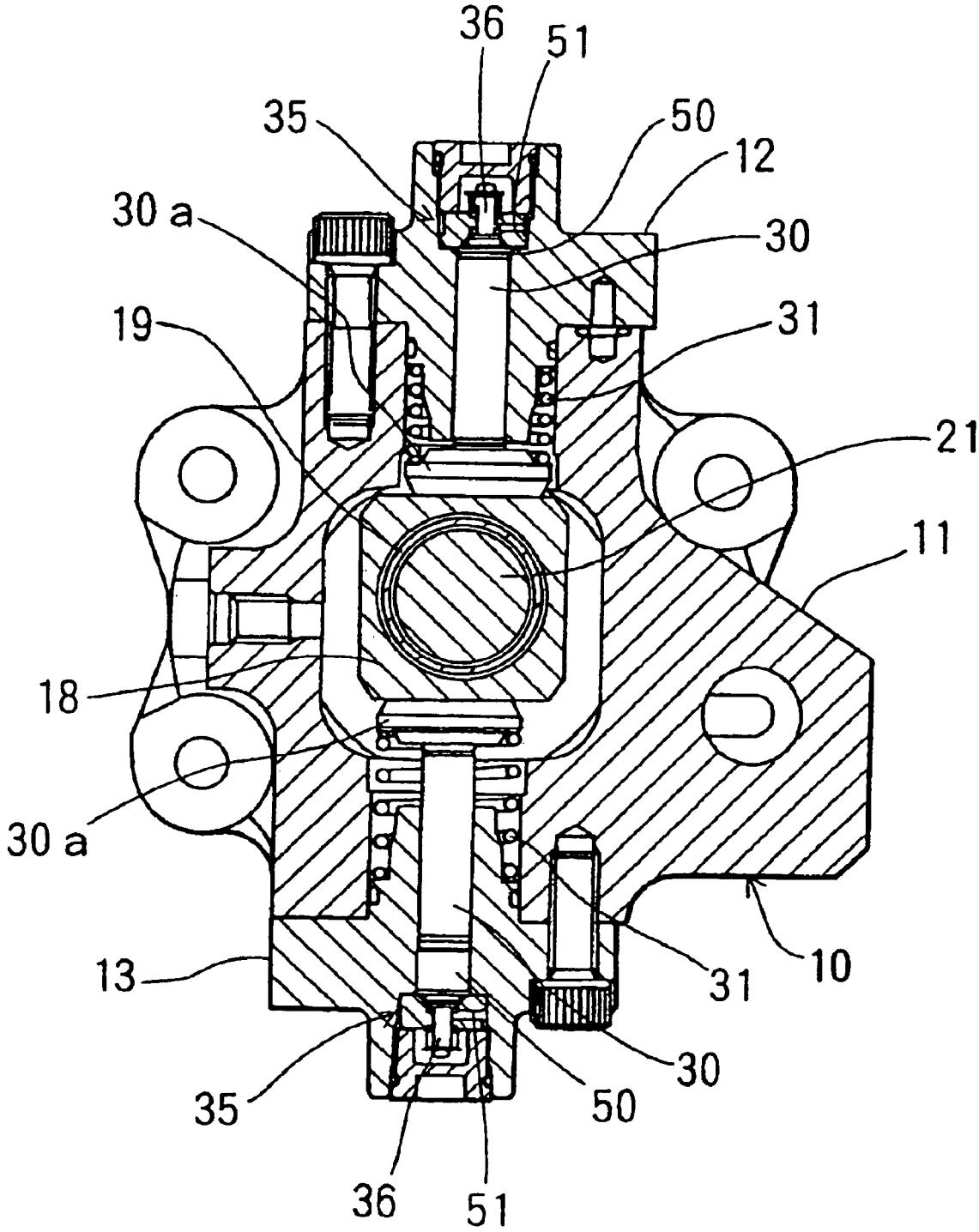
FIG. 2 is a cross sectional view taken along a line II—II of FIG. 1.

As shown in FIG. 2, the camshaft is integrally provided with a cam 21 whose cross section is formed in circular shape. An axis of the cam 21 is off set from an axis of the camshaft 20. The plunger 30 in the cylinder head 12 and the plunger 30 in the cylinder head 13 are arranged on radially opposite sides of the camshaft 20 with 180° angular intervals. A square shaped shoe 18 has a flat surface, which faces the plunger 30 and contacts a flat surface end of a plunger head 30*a*. The shoe 18 has a center bore into which the cam 21 is inserted via a bush 19 that is slidable between the shoe 18 and the cam 21.

As shown in FIG. 1, a disk shaped member 22 is formed integrally with the camshaft 20 at a place of the camshaft 20 extending forward from and adjacent to the cam 21 to a direction in which a helical gear 23 urges the camshaft 20. The disk shaped member 22 and a bearing portion 20*a* of the camshaft 20, which is held by the journal bearing 15, are coaxially formed. An outer diameter of the disk shaped member 22 is larger that that of the cam 21. A washer 25 is arranged between the disk shaped member 22 and the bearing cover 14. A surface of the bearing cover 14 on a side of the disk shaped member 22 comes in slidable contact with the disk shaped member 22 via the washer 25 and constitutes a stopper surface. A washer 26 is arranged between the housing 11 and the cam 21 on an opposite side to the disk shaped member 22. The washers 25 and 26 are made of low frictional material having high hardness.

The helical gear 23 is attached to a leading end of the camshaft 20 and rotated along with the camshaft 20. The helical gear 23 is driven by a series of gears (not shown) to receive a driving force from an engine crankshaft. The helical gear 23 rotates in a direction shown by an arrow A of FIG. 1. As the helical gear 23 receives the driving force in the arrow A direction, the camshaft is urged in a direction shown by an arrow B of FIG. 1.

The plunger 30 is driven reciprocatingly via the shoe 18 by the cam 21 according to the rotation of the camshaft 20 so that fuel sucked into the fuel pressure chamber via the return valve 35 from a fuel intake conduit 51 is pressurized. The return valve 35 serves to prevent a reverse flow of fuel from the fuel pressure chamber 50 to the fuel intake conduit 51.

A spring 31 biases the plunger 30 toward the shoe 18. As the respective surfaces of the shoe 18 and the plunger 30 which come in contact with each other are formed in flat shape, face pressure of the shoe 18 and the plunger 30 in contact with each other is small. While the cam 21 rotates about the axis of the camshaft 20, the shoe 18 slidably revolves around the cam 21 without rotation.

Connecting members 41 and 42 for providing fuel conduits are connected to the cylinder heads 12 and 13, respectively. A fuel discharge conduit 52 is formed in each of the connecting members 41 and 42 and in each of the cylinder heads 12 and 13. A return valve 37 having a return valve element 38 is arranged in the fuel discharge conduit 52. The return valve 37 serves to prevent fuel from flowing in reverse from the fuel discharge conduit 62 to the fuel pressure chamber 50. Fuel pressurized in the fuel pressure chamber 50 is supplied from each of the connecting members 41 and 42 via a fuel conduit (not shown) to a common rail (not shown).

Next, an operation of the fuel injection pump 10 is described.

When the camshaft 20 rotates, the cam 21 rotates and the shoe 18 revolves around the cam 21. According to the revolution of the shoe 18, the plunger 30 moves reciprocatingly, while the respective flat surfaces of the shoe 18 and plunger 30 are in slidable contact with each other.

When the plunger 30 moves downward from an upper dead point thereof according to the revolution of the shoe 18, fuel, which is delivered by a feed pump 60 and whose amount is adjusted by an adjusting valve (not shown), is sucked from the fuel intake conduit 51 via the return valve 35 to the fuel pressure chamber 50. When the plunger 30 moves upward toward the upper dead point after having reached a lower dead point thereof, the return valve 35 is closed and fuel pressure in the fuel pressure chamber 50 increases. When fuel pressure in the fuel pressure chamber exceeds fuel pressure on a downstream side of the return valve 37, the return valve 37 is opened in return. Fuel, which is supplied from each of the connecting members 41 and 42 via the fuel conduit to the common rail, is accumulated in the common rail so that fuel pressure therein is kept at a predetermined value. Then, high pressure fuel is supplied from the common rail to respective injectors (not shown).

The helical gear 23 receives driving force in a direction shown by the arrow A from the engine crankshaft so that the camshaft 20 is biased in a direction shown by the arrow B. Since the disk shaped member 22, whose diameter is larger than that of the cam 21, is biased, while rotating, via the washer 25 against the surface of the bearing cover 14, an area where the disk shaped member 22 and the washer 25 come in slidable contact with each other is larger, compared with an area where the cam 21 and the washer 25 comes in direct and slidable contact with each other. Further, since the disk shaped member 22 is formed in the same axis to the bearing portion 20*a* of the camshaft 20 that are held by the journal bearing 15, a circumferential periphery of the disk shaped member 22 is always in slidable contact with the washer 25. Accordingly, frictional wear of the disk shaped member 22 due to the sliding movement is limited.

Instead of or in addition to arranging the disk shaped member 22 at the portion of the camshaft 20 extending forward from the cam 21 to the direction in which the camshaft 20 receives the biasing force through the helical gear 23, the disk shaped member 22 may be arranged at a portion of the camshaft extending backward from the cam 21 to the direction in which the camshaft 20 receives the biasing force.

(Second Embodiment)

Figure 3:
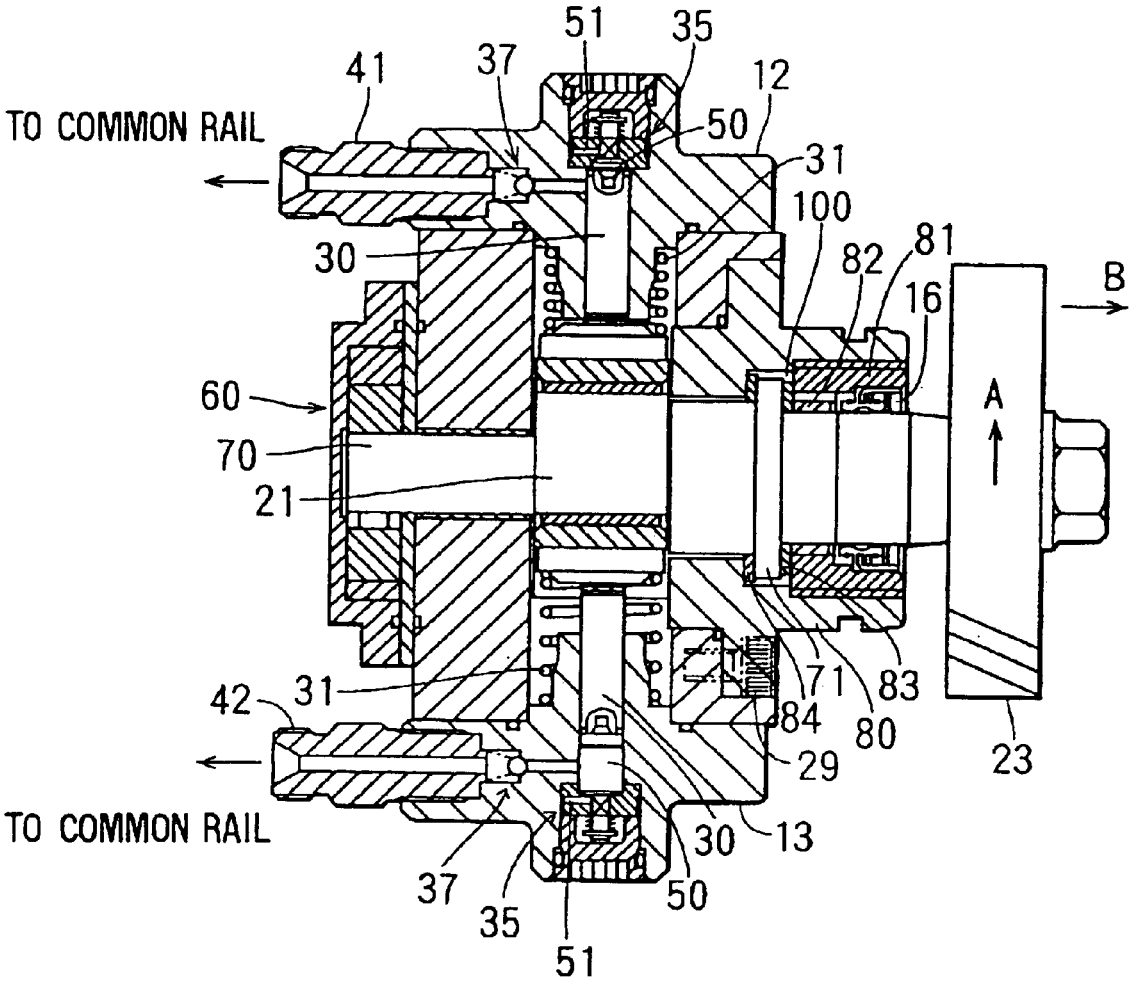
FIG. 3 is across sectional view showing a fuel injection pump according to a second embodiment of the present invention.

A fuel injection pump according to a second embodiment is described with reference to FIG. 3. Construction and feature same as those of the first embodiment have same reference numbers.

A bearing cover 80, which is a first connecting member, is fastened to the housing body 11 by bolts 29. A screw 81, which is a second connecting member, is screwed into the bearing cover 80. The screw 81 is provided inside with a journal bearing 82 by which the camshaft is rotatably held. A disk shaped member 71, which is formed integrally with the camshaft 70, is located at a portion of the camshaft 70 extending forward away from the cam 21 to a direction in which the camshaft 70 receives a driving force through the helical gear 23. The disk shaped member 71 is housed in a space 100 of the bearing cover 80 that is provided between the bearing cover 80 and the screw 81. The disk shaped member 71 is put between washers 83 and 84 in the space 100 of the bearing cover 80. The washer 83 is arranged on a side of the screw 81 and the washer 84 is arranged on a side of the bearing cover 80. The disk shaped member 71 is biased via the washer 83 against an end surface of the screw 81 by a biasing force that the helical gear receives. The end surface of the screw 81 and the washer 83 constitute a stopper surface.

As the bearing cover 80 and the screw 81 are formed separately from the housing body 11, respectively, an axial length of the space 100, in which the disk shaped member is housed, is easily adjusted to an optimum value before the cylinder heads 12 and 13 are assembled to the housing body 11. Accordingly, even if the camshaft 70 moves in an opposite direction to a direction in which the helical gear 23 urges the camshaft 70 due to a reaction of the driving force from the crankshaft, there occur less hammer noises. Further, as the disk shaped member 71 generally slides only the washer 83 and does not slide the washer 84, frictional wear of the disk shaped member 71 is reduced.

The axial length of the space 100 is easily adjusted to prevent the hammer noises after the disk shaped member 22 is housed in the space 100, even in a fuel injection pump in which the camshaft is biased in a direction opposite to the direction mentioned in the second embodiment. In this case, a surface of the bearing cover 80 on a side of the washer 84 and the washer 84 constitute the stopper surface.

According to the embodiments mentioned above, the disk shaped member provided in the camshaft, not the cam 21, is biased against the stopper surface by the axial biasing force transmitted via the helical gear 23. As the area where the disk shaped member comes in slidable contact with the stopper surface is larger than the area where the cam 21 comes in slidable contact with the stopper surface, face pressure of the disk shaped member and the stopper surface in contact becomes smaller. Further, as the disk shaped member is arranged in the same axis to the bearing portion 20*a* of the camshaft 20, regions of the disk shaped member and the washer in sliding contact with each other are always same so that frictional wear of the disk shaped member is limited and longer life time thereof is ensured.

Instead of the helical gear for transmitting the driving force to the camshaft, a belt may be used for transmitting the driving force to the camshaft. In this case, it becomes necessary to employ biasing means, for example, a spring for biasing the camshaft in one axial direction thereof.

What is claimed is:

1. A fuel injection pump comprising;

a camshaft having a cam and a disk shaped member which are axially spaced apart and rotatable therewith, an axis of the cam being offset from an axis of the camshaft and an axis of the disk shaped member being coaxial with the axis of the camshaft;

a housing body having a fuel pressure chamber, a part of the camshaft including the cam being housed in the housing body;

a bearing cover having a bearing, the bearing cover being fixed to the housing body so that the bearing rotatably holds another part of the camshaft on an opposite side to the cam with respect to the disk shaped member and the disk shaped member is sandwiched between the housing body and the bearing cover, wherein one of the housing body and the bearing cover is provided at an end surface thereof facing to the disk shaped member with a stopper surface for restricting an axial movement of the camshaft;

a movable member driven by the cam so as to move reciprocatingly so that fuel sucked into the fuel pressure chamber is pressurized and discharged; and biasing means for urging the camshaft in one axial direction thereof so that the disk shaped member is pressed against and comes in slidable contact with the stopper surface without contacting the bearing.

2. A fuel injection pump according to claim 1, wherein the biasing means is a helical gear provided coaxially in the camshaft and driven by a driving force from outside so that, according to the rotation of the helical gear, the camshaft is rotated, while being urged in the one axial direction thereof.

3. A fuel injection pump according to claim 1, wherein the bearing cover is provided at a portion thereof around the camshaft with a cylindrical recess whose bottom constitutes the stopper surface so that the disk shaped member is accommodated in the cylindrical recess and a side surface of the disk shaped member on a side of the bearing cover comes in slidable contact with the stopper surface when the biasing means urges the camshaft in the one axial direction thereof.

4. A fuel injection pump according to claim 1, further comprising:

a washer disposed between the disk shaped member and the stopper surface so that the disk shaped member comes in slidable contact with the stopper surface via the washer.

5. A fuel injection pump according to claim 1, wherein an outer diameter of the disk shaped member is larger than that of the cam.

* * * * *